US011587519B1

(12) United States Patent
Imai et al.

(10) Patent No.: US 11,587,519 B1
(45) Date of Patent: Feb. 21, 2023

(54) DISPLAY DEVICE

(71) Applicant: Japan Display Inc., Tokyo (JP)

(72) Inventors: Takayuki Imai, Tokyo (JP); Kentaro Okuyama, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/873,677

(22) Filed: Jul. 26, 2022

(30) Foreign Application Priority Data

Jul. 28, 2021 (JP) ..... JP2021-123429

(51) Int. Cl.
*G09G 3/36* (2006.01)

(52) U.S. Cl.
CPC ... *G09G 3/3607* (2013.01); *G09G 2310/0235* (2013.01); *G09G 2320/0276* (2013.01)

(58) Field of Classification Search
CPC ..... G09G 3/3607; G09G 2310/0235; G09G 2320/0276
See application file for complete search history.

(56) References Cited

U.S. PATENT DOCUMENTS

2017/0047021 A1* 2/2017 Yashiki ..... G09G 3/34

FOREIGN PATENT DOCUMENTS

JP 2015038544 A 2/2015

* cited by examiner

*Primary Examiner* — Kenneth B Lee, Jr.
(74) *Attorney, Agent, or Firm* — K&L Gates LLP

(57) ABSTRACT

A display device includes: first and second substrates with a liquid crystal therebetween; pixel electrodes and a common electrode provided to the first or second substrate; a light source including first to third light sources; and an image processor generating a signal to be provided to each pixel based on an input image signal. A frame period includes a first subframe period in which the first light source is on, a second subframe period in which the second light source is on, a third subframe period in which the third light source is on, and a fourth subframe period in which one or more of the first to third light sources are on. The image processor divides a gradation value into two values smaller than the gradation value, allocates one of the two values to the fourth subframe period, and allocates the other value to the other first subframe period.

8 Claims, 12 Drawing Sheets

DISPLAY DEVICE

CROSS-REFERENCE TO RELATED APPLICATION

This application claims the benefit of priority from Japanese Patent Application No. 2021-123429 filed on Jul. 28, 2021, the entire contents of which are incorporated herein by reference.

BACKGROUND

1. Technical Field

What is disclosed herein relates to a display device.

2. Description of the Related Art

There has been known a liquid crystal display device that performs display output using what is called a field sequential color (FSC) scheme in which pixels are controlled so that light in a plurality of colors is transmitted from the same pixel at different timings, respectively (for example, Japanese Patent Application Laid-open Publication No. 2015-038544 (JP-A-2015-038544)).

As a liquid crystal display device to which such a scheme as disclosed in JP-A-2015-038544 described above is applied, a display device is known which employs a polymer-dispersed liquid crystal (PDLC) to enable control of the degree of light scattering at each of a plurality of pixels. In such a display device, voltage applied to pixels in order to increase the degree of light scattering tends to be higher than voltage applied to pixels in a liquid crystal display device using another scheme, and such high voltage makes it difficult to extend the lifetime of pixels in some cases.

For the foregoing reasons, there is a need for a display device that can achieve a longer lifetime.

SUMMARY

According to an aspect, a display device includes: a first substrate; a second substrate facing the first substrate; a liquid crystal sandwiched between the first substrate and the second substrate; pixel electrodes provided to the first substrate or the second substrate and disposed individually at a plurality of pixels; a common electrode provided to the first substrate or the second substrate and shared by two or more pixels of the pixels; a light source configured to emit light to the pixels; and an image processor configured to generate a signal to be provided to each pixel based on an input image signal. The light source includes a first light source configured to emit light in a first color, a second light source configured to emit light in a second color, and a third light source configured to emit light in a third color. A frame period in which an image is displayed by the pixels includes a first subframe period including a period in which the first light source is on, a second subframe period including a period in which the second light source is on, a third subframe period including a period in which the third light source is on, and a fourth subframe period including a period in which one or more of the first light source, the second light source, and the third light source are on. The image processor configured to divide a gradation value indicated by the image signal into two gradation values smaller than the gradation value indicated by the image signal, allocate one of the two gradation values to the fourth subframe period, and allocate the other gradation value to the first subframe period, the second subframe period, or the third subframe period.

DETAILED DESCRIPTION

Figure 1:
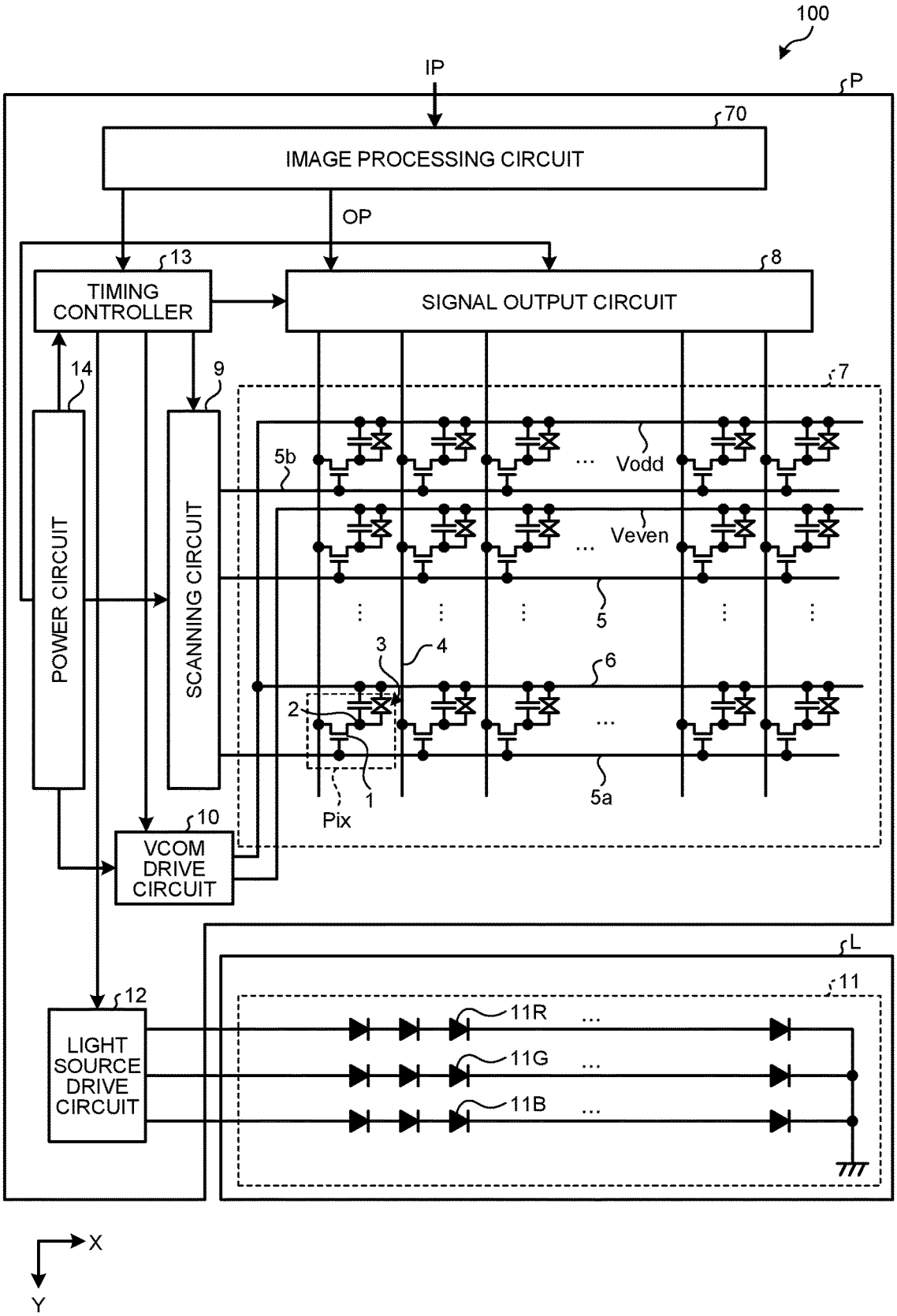
FIG. 1 is a schematic circuit diagram illustrating a main configuration of a display device.

An embodiment of the present disclosure will be described below with reference to the accompanying drawings. What is disclosed herein is merely exemplary, and any modification that could be easily thought of by the skilled person in the art as appropriate without departing from the gist of the invention is included in the scope of the present disclosure. In the drawings, the width, thickness, shape, and the like of each component are schematically illustrated for clearer description as compared to actual aspects in some cases, but are merely exemplary and do not limit interpretation of the present disclosure. In the present specification and the drawings, any component same as that already described with reference to an already described drawing is denoted by the same reference sign, and detailed description thereof is omitted as appropriate in some cases.

In this disclosure, when an element is described as being "on" another element, the element can be directly on the other element, or there can be one or more elements between the element and the other element.

First Embodiment

FIG. 1 is a schematic circuit diagram illustrating a main configuration of a display device 100. The display device 100 includes a display panel P and a light source device L.

The display panel P includes a display part 7, a signal output circuit 8, a scanning circuit 9, a VCOM drive circuit 10, a timing controller 13, and a power circuit 14. Hereinafter, one surface of the display panel P facing the display part 7 is referred to as a display surface, and the other surface is referred to as a back surface. Lateral sides of the display device 100 are positioned on the sides of the display device 100 in a direction intersecting (for example, orthogonal to) a direction in which the display surface faces the back surface.

Figure 2:
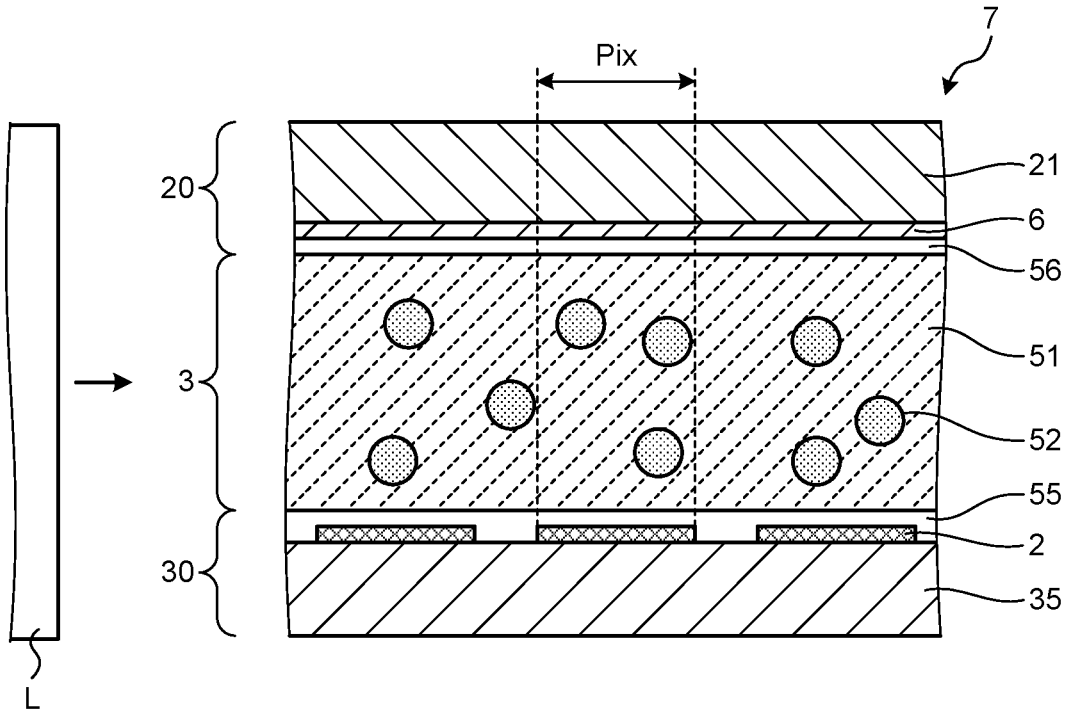
FIG. 2 is a schematic diagram illustrating a schematic section of a display part and the relation between the display part and a light source device.

In the display part 7, a plurality of pixels Pix are disposed in a matrix (a row-column configuration). Each pixel Pix includes a switching element 1 and two electrodes. In FIG. 1 and FIG. 2 to be described later, a pixel electrode 2 and a common electrode 6 are illustrated as the two electrodes.

FIG. 2 is a schematic diagram illustrating a schematic section of the display part 7 and the relation between the display part 7 and the light source device L. The display part 7 includes two facing substrates and a liquid crystal 3 enclosed between the two substrates. Hereinafter, one of the two substrates is referred to as a first substrate 30, and the other is referred to as a second substrate 20.

The first substrate 30 includes a light-transmitting glass substrate 35, the pixel electrodes 2 stacked on the second substrate 20 side of the glass substrate 35, and an insulating layer 55 stacked on the second substrate 20 side to cover each of the pixel electrodes 2. The pixel electrode 2 is provided individually for each pixel Pix. The second substrate 20 includes a light-transmitting glass substrate 21, the common electrodes 6 stacked on the first substrate 30 side of the glass substrate 21, and an insulating layer 56 stacked on the first substrate 30 side to cover the common electrode 6.

Each common electrode 6 illustrated in FIG. 1 has a plate or film shape shared by a plurality of pixels Pix arranged in an X direction. The common electrodes 6 include common electrodes Vodd and common electrodes Veven. Among the plurality of common electrodes 6 arranged in a Y direction, the common electrodes Vodd are the common electrodes 6 arranged with odd numbers when counted from one end side in the Y direction. The common electrodes Veven are the common electrodes 6 arranged with even numbers when counted from the one end side in the Y direction. In an exemplary configuration to be described below with reference to FIGS. 1 and 2, the pixel electrode 2 included in one of two adjacent pixels Pix in the Y direction faces the corresponding one of the common electrodes Vodd, and the pixel electrode 2 included in the other pixel Pix faces the corresponding one of the common electrodes Veven.

The liquid crystal 3 of the first embodiment is a polymer-dispersed liquid crystal. Specifically, the liquid crystal 3 includes a bulk 51 and fine particles 52. The orientations of the fine particles 52 change in accordance with the potential difference between the pixel electrode 2 and the common electrode 6 in the bulk 51. As the potential of the pixel electrode 2 is controlled individually for each pixel Pix, at least either the degree of translucency or the degree of scattering is controlled for the pixel Pix.

In the first embodiment described with reference to FIG. 2, the pixel electrode 2 and the common electrode 6 face each other with the liquid crystal 3 sandwiched therebetween, but the display part 7 may have a configuration in which the pixel electrode 2 and the common electrode 6 are provided to one substrate and the orientation of the liquid crystal 3 is controlled by an electric field generated by the pixel electrode 2 and the common electrode 6.

The following describes a configuration for controlling the potentials of the pixel electrode 2 and the common electrode 6. As illustrated in FIG. 1, the switching element 1 is a switching element using a semiconductor, such as a thin film transistor (TFT). One of the source and drain of the switching element 1 is coupled to one (the pixel electrode 2) of the two electrodes. The other of the source and drain of the switching element 1 is coupled to a signal line 4. The gate of the switching element 1 is coupled to a scanning line 5. Under control of the scanning circuit 9, the scanning line 5 provides potential for opening and closing the source-drain of the switching element 1. This potential control is performed by the scanning circuit 9.

In the example illustrated in FIG. 1, a plurality of the signal lines 4 are arranged in one (row direction) of directions in which the pixels Pix are arranged. The signal lines 4 extend in the other arrangement direction (column direction) of the pixels Pix. Each signal line 4 is shared by the switching elements 1 of more than one of the pixels Pix arranged in the column direction. A plurality of the scanning lines 5 are arranged in the column direction. The scanning lines 5 extend in the row direction. Each scanning line 5 is shared by the switching elements 1 of more than one of the pixels Pix arranged in the row direction.

In description of the first embodiment, the extending direction of the scanning line 5 is referred to as the X direction, and the direction in which the scanning lines 5 are arranged is referred to as the Y direction. In FIG. 1, one of scanning lines 5 disposed at both ends in the Y direction among the scanning lines 5 is referred to as a scanning line 5*a*, and the other is referred to as a scanning line 5*b*.

The common electrode 6 is coupled to the VCOM drive circuit 10. The VCOM drive circuit 10 provides potential that functions as a common potential to the common electrode 6. When the signal output circuit 8 outputs a pixel signal to be described later to the signal line 4 at a timing at which the scanning circuit 9 provides a potential that functions as a drive signal to the scanning line 5, a storage capacitor formed between the corresponding pixel electrode 2 and the common electrode 6 and the liquid crystal (fine particles 52) as a capacitive load are charged. Thus, the voltage between the pixel Pix and the common electrode 6 becomes a voltage corresponding to the pixel signal. After the drive signal becomes no longer provided, the storage capacitor and the liquid crystal (fine particles 52) as the capacitive load hold the pixel signal. The scattering degree of the liquid crystal (fine particles 52) is controlled in accordance with the voltage of each pixel Pix and the voltage of the common electrode 6. The liquid crystal 3 may be, for example, a polymer-dispersed liquid crystal having a scattering degree that increases as the voltage between each pixel Pix and the common electrode 6 increases, or may be a polymer-dispersed liquid crystal having a scattering degree that increases as the voltage between each pixel Pix and the common electrode 6 decreases.

As illustrated in FIG. 2, the light source device L is disposed on a lateral side of the display part 7. The light source device L includes a light source 11 and a light source drive circuit 12. The light source 11 includes a first light source 11R configured to emit red (R) light, a second light source 11G configured to emit green (G) light, and a third light source 11B configured to emit blue (B) light. The first light source 11R, the second light source 11G, and the third light source 11B each emit light under control of the light source drive circuit 12. The first light source 11R, the second light source 11G, and the third light source 11B of the first embodiment are each, for example, a light source using a light emitting element such as a light emitting diode (LED), but the present disclosure is not limited thereto. Each light source may be any light source, the light emission timing of which is controllable. The light source drive circuit 12 controls the light emission timings of the first light source 11R, the second light source 11G, and the third light source 11B under control of the timing controller 13. In the first embodiment, red (R) is a first primary color. In the first embodiment, green (G) is a second primary color. In the first embodiment, blue (B) is a third primary color. In a subframe period SF and an adjustment subframe period Ad to be described later, the first light source 11R, the second light source 11G, and the third light source 11B can each emit light alone, and two or three of the first light source 11R, the second light source 11G, and the third light source 11B can simultaneously emit light.

When light is emitted from the light source 11, the display part 7 is illuminated with light incident from one side surface in the Y direction. Each pixel Pix transmits or scatters the light incident from one side surface in the Y direction. The scattering degree depends on the state of the liquid crystal 3 controlled in accordance with a pixel signal.

The timing controller 13 is a circuit configured to control the operation timings of the signal output circuit 8, the scanning circuit 9, the VCOM drive circuit 10, and the light source drive circuit 12. In the first embodiment, the timing controller 13 operates based on a signal inputted through an image processing circuit 70. The power circuit 14 outputs various potentials necessary for operation of the display device 100 based on electric power supplied from the outside.

The image processing circuit 70 outputs, to the signal output circuit 8 and the timing controller 13, a signal based on frame image data IP from the outside of the display device 100. When data indicating an RGB gradation value allocated to a pixel Pix is referred to as pixel data, the frame image data IP input to the image processing circuit 70 to output a frame image is a set of a plurality of pieces of pixel data for the pixels Pix provided to the display part 7.

Figure 3:
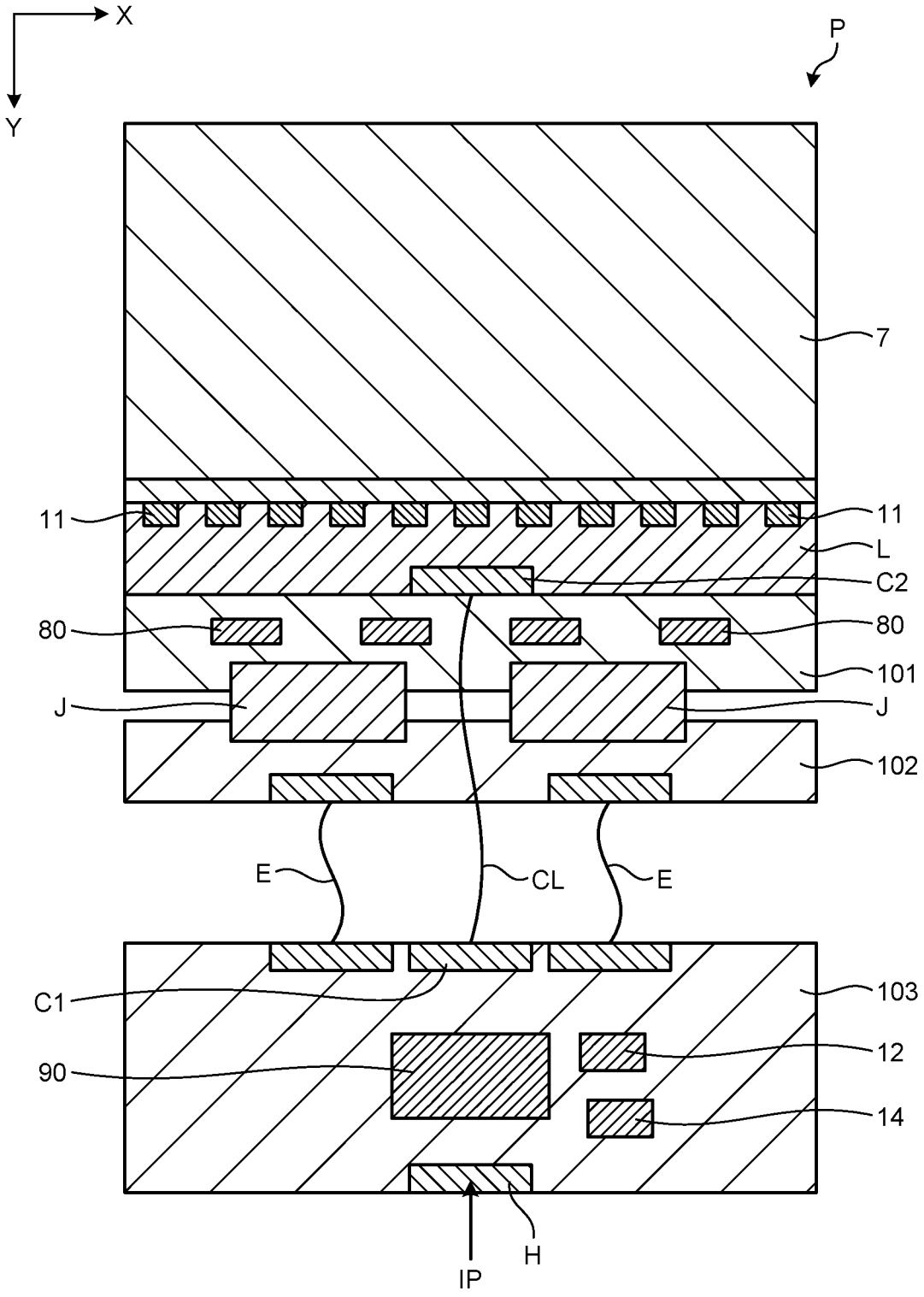
FIG. 3 is a schematic diagram illustrating an exemplary specific configuration of a display panel.

FIG. 3 is a schematic diagram illustrating an exemplary specific configuration of the display panel P. The display panel P illustrated in FIG. 1 includes, for example, a first panel 101, a circuit board 102, and a circuit board 103 illustrated in FIG. 3.

The first panel 101 includes the display part 7, the light source device L, and a driver circuit 80. The light source device L is mounted on the lateral side with respect to the display part 7 (for example, the lateral side in the Y direction), and the driver circuit 80 is disposed on a side opposite the display part 7 with the light source device L interposed therebetween at a plan-view point. The driver circuit 80 is a circuit having functions of the signal output circuit 8, the scanning circuit 9, and the VCOM drive circuit 10, which are illustrated in FIG. 1, and mounted on the first panel 101.

The circuit board 102 and the circuit board 103 are coupled to the first panel 101. The circuit board 103 is a circuit board on which a control circuit 90 as well as the light source drive circuit 12 and the power circuit 14, which are illustrated in FIG. 1, are implemented. The control circuit 90 is a circuit having functions of the image processing circuit 70 and the timing controller 13, which are illustrated in FIG. 1.

The light source drive circuit 12 and the power circuit 14 are coupled to the light source device L through a coupling line CL. The coupling line CL couples a connector C1 provided to the first panel 101 and a connector C2 provided to the light source device L. Although not illustrated in detail, a wire coupled to the light source 11 of the light source device L is also coupled to the connector C2. Wiring coupled to the light source drive circuit 12 and wiring coupled to the power circuit 14 are coupled to the connector C1 through a non-illustrated wiring layer provided to the first panel 101.

Similarly, although detailed wiring is not illustrated, the power circuit 14 and the control circuit 90 mounted on the circuit board 103 are coupled to the first panel 101 through the circuit board 102, coupling lines E, and wiring substrates J such as flexible printed circuits (FPC) as illustrated in FIG. 3. The circuit board 102 may be omitted, and the circuit board 103 may be coupled to the first panel 101 through the coupling lines E or wiring substrates J. The circuit board 103 is provided with an interface H for being coupled to an external apparatus (host) that outputs the frame image data IP.

Figure 4:
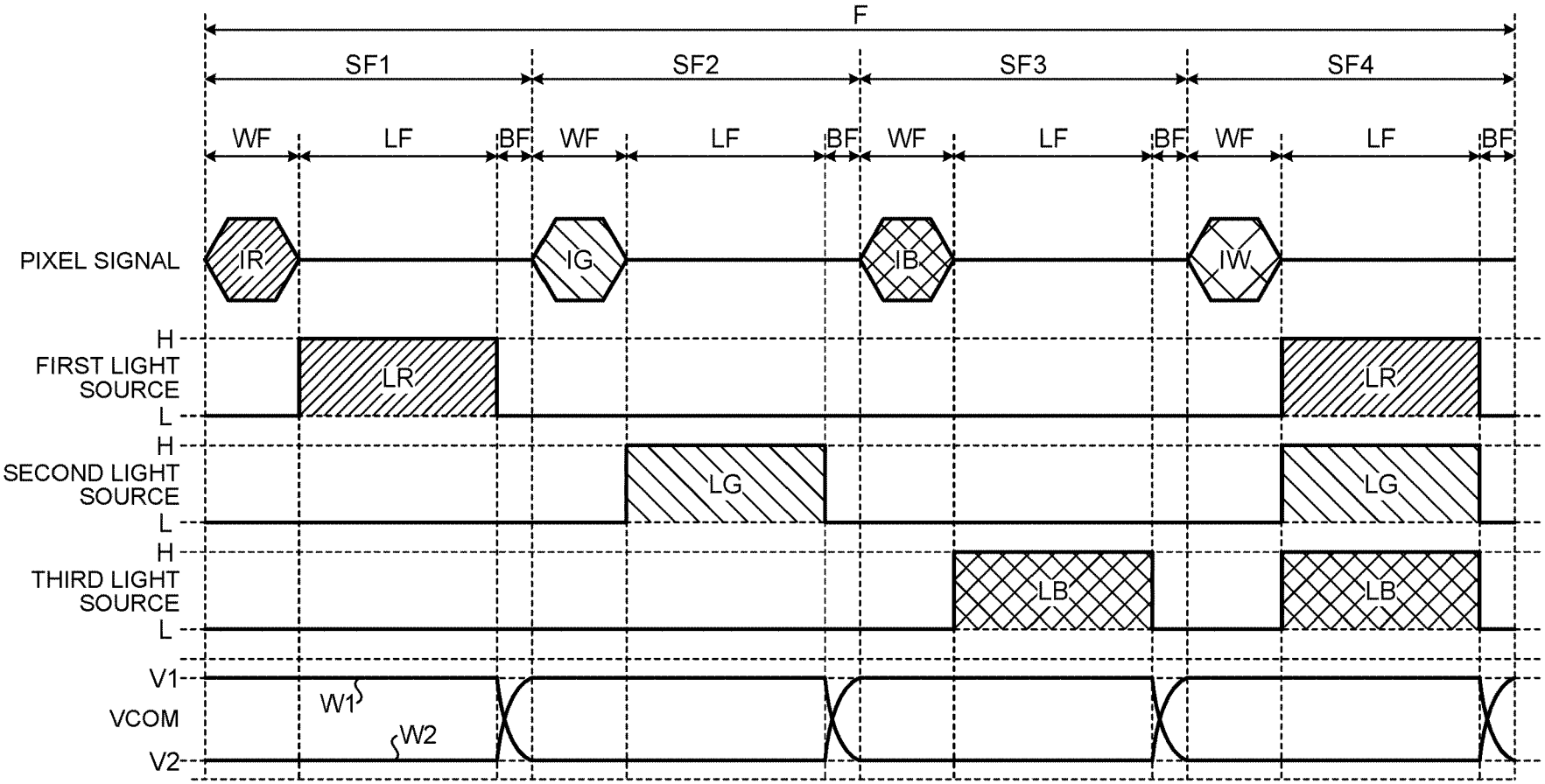
FIG. 4 is a time chart illustrating the details of exemplary control using a FSC scheme applied to an embodiment.
Figure 7:
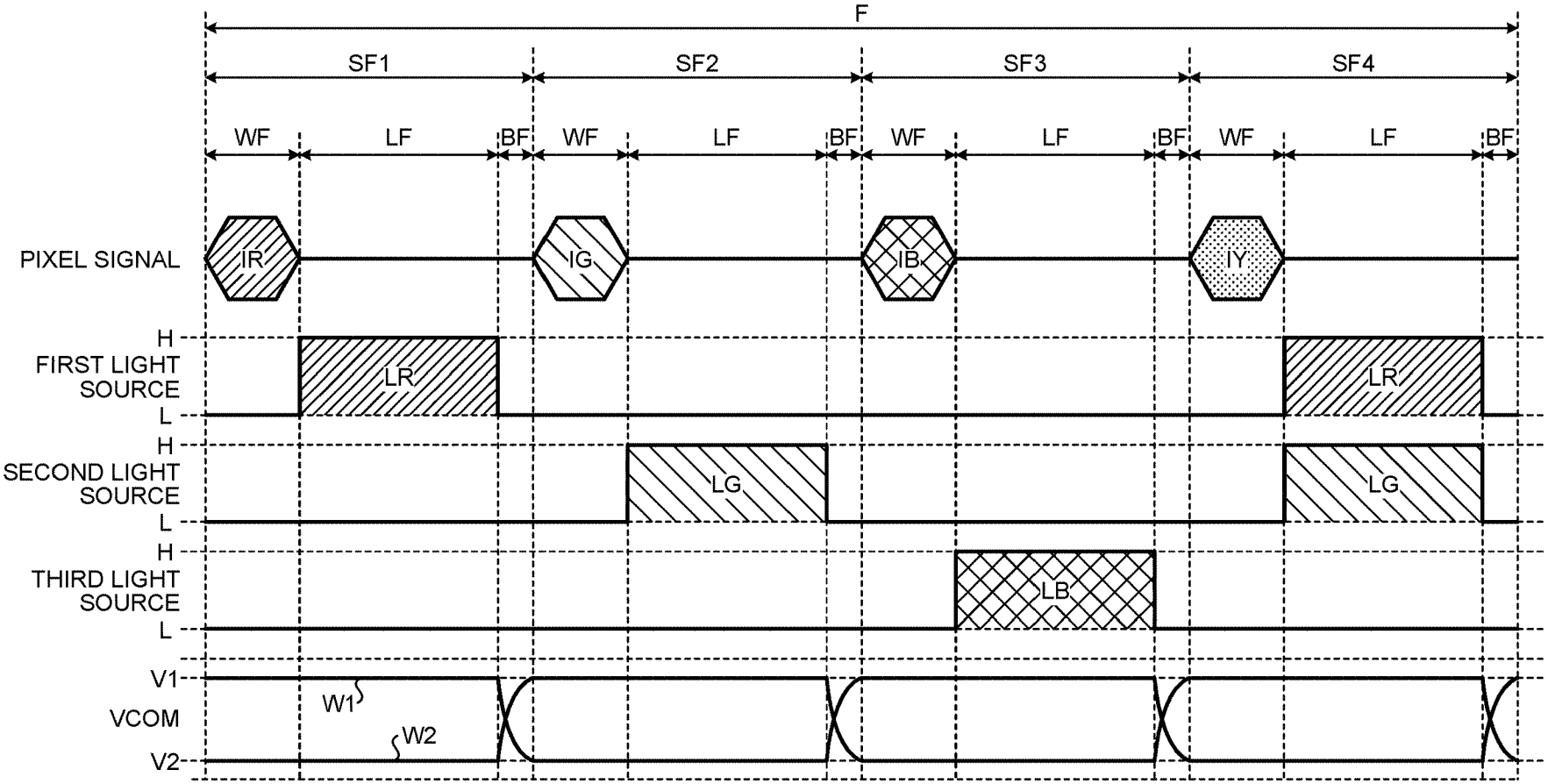
FIG. 7 is a time chart illustrating the details of exemplary control using the FSC scheme when a pixel signal is provided to a pixel in a writing period of a fourth subframe period.
Figure 9:
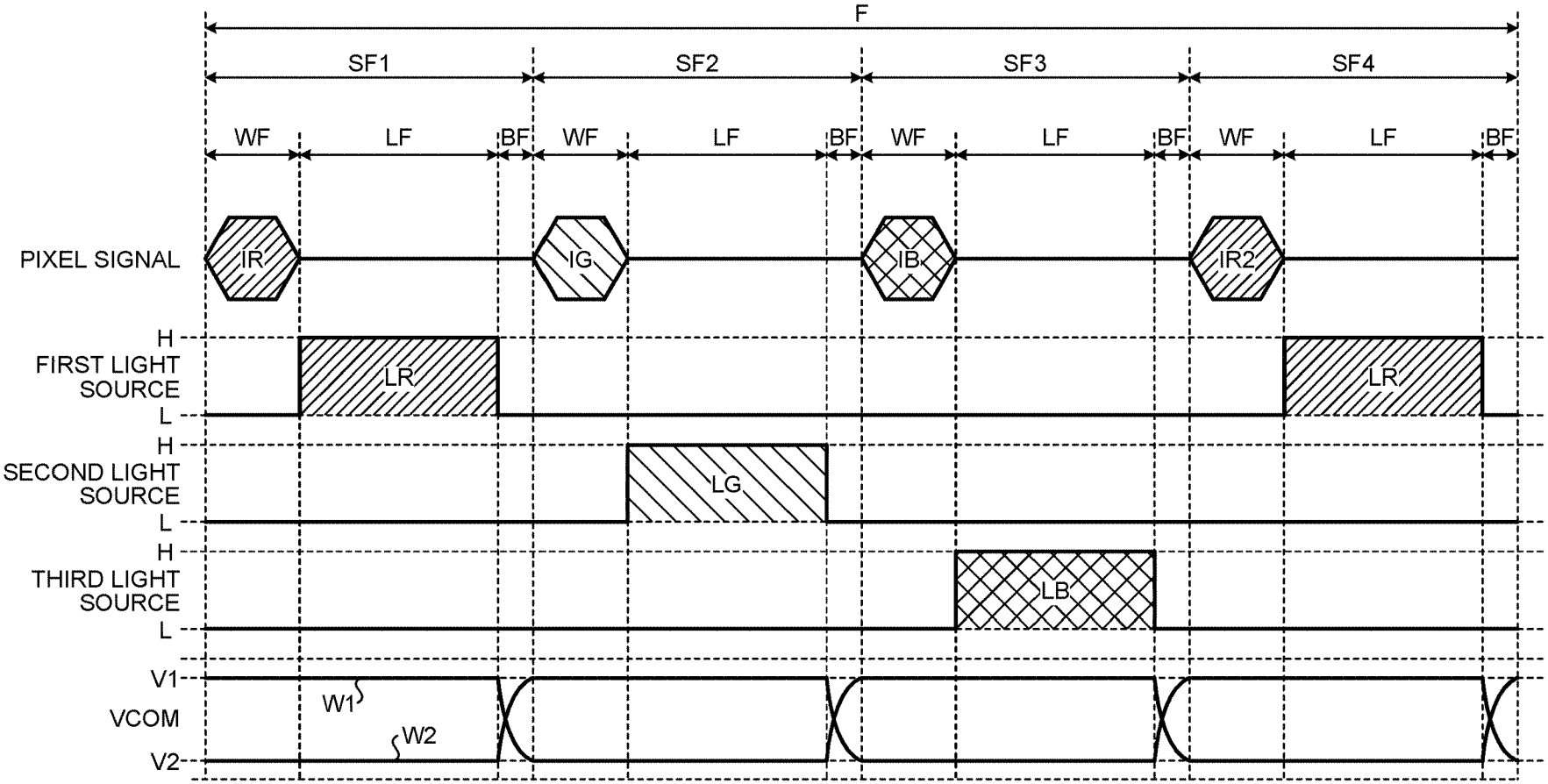
FIG. 9 is a time chart illustrating the details of exemplary control using the FSC scheme when a pixel signal is provided to a pixel in the writing period of the fourth subframe period.

The following describes the control contents of a FSC scheme applied to the embodiment. FIG. 4 is a time chart illustrating the details of exemplary control using the FSC scheme applied to the embodiment. In FIG. 4 and FIGS. 7 and 9 to be described later, a frame period F is a period in which various kinds of control related to display of one frame image are performed, and the relation between various events that occur in the frame period F is illustrated as a time chart. When a plurality of frame images are displayed continuously in time, the same control as that described for the frame period F is repeated.

As illustrated in FIG. 4, the frame period F includes a first subframe period SF1, a second subframe period SF2, a third subframe period SF3, and a fourth subframe period SF4. The first subframe period SF1, the second subframe period SF2, the third subframe period SF3, and the fourth subframe period SF4 each include a writing period WF, a lighting period LF, and a blanking period BF.

The writing period WF is a period provided before the lighting period LF of the subframe period. The writing period WF is a period in which a pixel signal is provided to the pixel Pix. Specifically, in the writing period WF, the scanning circuit 9 provides a potential that functions as the drive signal to the scanning line 5. When the signal output circuit 8 outputs a pixel signal to be described later to the signal line 4 at a timing at which the drive signal is provided, the storage capacitor formed between the pixel electrode 2 and the common electrode 6 and the liquid crystal (fine particles 52) as a capacitive load are charged. Thus, voltage between the pixel Pix and the common electrode 6 becomes voltage corresponding to the pixel signal.

In the writing period WF, scanning is performed by the scanning circuit 9. Specifically, the scanning circuit 9 provides the drive signal to the plurality of scanning lines 5 at different timings, respectively. Thus, the pixels Pix arranged in the arrangement direction of the scanning lines 5 can be driven at different timings, respectively. Then, the pixel signals are individually output to the plurality of signal lines 4 so that the pixels Pix arranged in the arrangement direction of the signal lines 4 are provided with different pixel signals, respectively.

A pixel signal IR provided to the pixel Pix in the writing period WF of the first subframe period SF1, a pixel signal IG provided to the pixel Pix in the writing period WF of the second subframe period SF2, a pixel signal IB provided to the pixel Pix in the writing period WF of the third subframe period SF3, and a pixel signal (for example, a pixel signal IW illustrated in FIG. 4) provided to the pixel Pix in the writing period WF of the fourth subframe period SF4 are different from one another.

In a specific example, R, G, and B gradation values expressed as (R, G, B)=(a, b, c) based on one piece of pixel data among a plurality of pieces of pixel data included in the frame image data IP. The pixel signal IR corresponds to part or all of "a", in other words, part or all of (R, G, B)=(a, 0, 0). The pixel signal IG corresponds to part or all of "b", in other words, part or all of (R, G, B)=(0, b, 0). The pixel signal IB corresponds to part or all of "c", in other words, part or all of (R, G, B)=(0, 0, c). The pixel signal IW illustrated in FIG. 4 is a signal corresponding to a color that can be generated by a combination of "a", "b", and "c".

Figure 5:
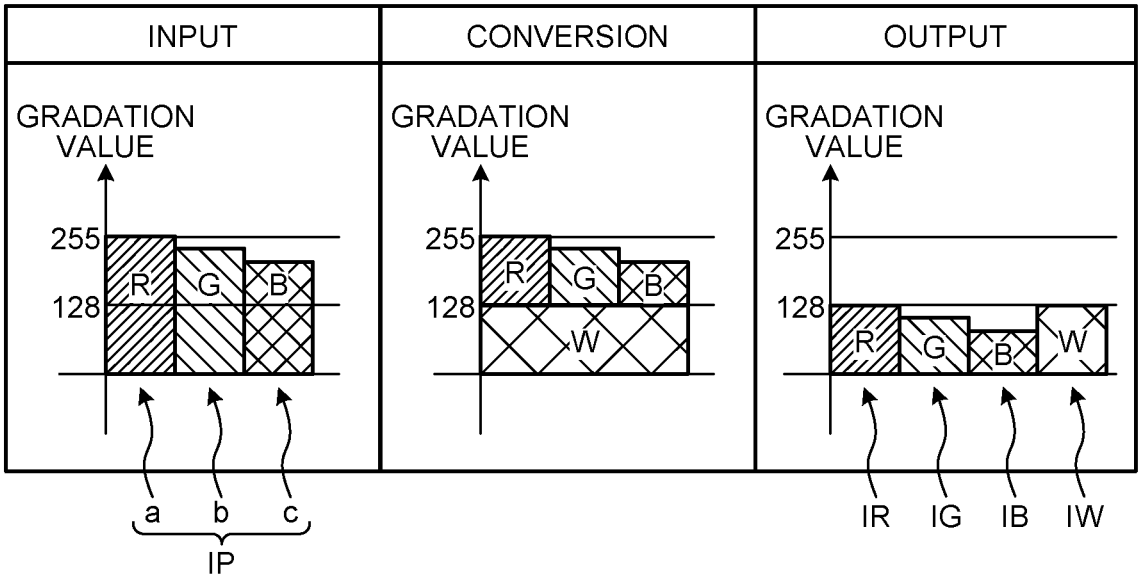
FIG. 5 is a diagram illustrating an exemplary relation between pixel data included in frame image data input to an image processing circuit and pixel signals output from the image processing circuit.

FIG. 5 is a diagram illustrating an exemplary relation between the pixel data included in the frame image data IP input to the image processing circuit 70 and the pixel signals IR, IG, IB, and IW output from the image processing circuit 70. As illustrated in the "input" column in FIG. 5, the frame image data IP can be expressed as (R, G, B)=(a, b, c). In examples in FIG. 5 and FIGS. 8 and 10 to be described later, the highest values of "a", "b", and "c" are the highest value (255) of eight bits, but gradation values represented by the pixel data are not limited to eight bits and may be numerical values that can be expressed with a freely-determined number of bits.

The image processing circuit 70 performs, for example, conversion processing that converts part of (R, G, B)=(a, b, c) into a mixed color of R, G, and B. In FIG. 5, part of (R, G, B)=(a, b, c) is converted into a color component of white (W) as the mixed color of R, G, and B as illustrated in the "conversion" column. The image processing circuit 70 converts, into the mixed color of R, G, and B, any color component corresponding to a gradation value equal to or larger than the lowest value among values included in "a", "b", and "c" and equal to or smaller than half of the highest value among the values included in "a", "b", and "c".

In the "input" column in FIG. 5, "a", "b", and "c" are all equal to or larger than the middle value (128) of the gradation value. The value "a" is the highest value (255) of the gradation value. Thus, the image processing circuit 70 converts (R, G, B)=(127, 127, 127) among (R, G, B)=(a, b, c) into the color component of white (W). In the conversion into the color component of white (W), the image processing circuit 70 extracts an equal value (for example, 127) from "a", "b", and "c" in (R, G, B)=(a, b, c).

The image processing circuit 70 outputs, as the pixel signals IR, IG, and IB to the signal output circuit 8, signals corresponding to gradation values obtained by subtracting R, G, and B values included in the color component of the mixed color obtained by the conversion from (R, G, B)=(a, b, c). In a specific example, when (R, G, B)=(127, 127, 127) among (R, G, B)=(a, b, c) are converted into the color component of white (W) as described above, the image processing circuit 70 outputs, as the pixel signal IR, a signal corresponding to (a−127) in (R, G, B)=((a−127), 0, 0). In this case, the image processing circuit 70 outputs, as the pixel signal IG, a signal corresponding to (b−127) in (R, G, B)=(0, (b−127), 0). In addition, in this case, the image processing circuit 70 outputs, as the pixel signal IB, a signal corresponding to (c−127) in (R, G, B)=(0, 0, (c−127)).

The image processing circuit 70 also outputs, as the pixel signal IW to the signal output circuit 8, a signal corresponding to any non-zero gradation value among R, G, and B gradation values included in the color component of the mixed color obtained by the conversion among (R, G, B)=(a, b, c). In a specific example, when signals corresponding to (R, G, B)=(127, 127, 127) among (R, G, B)=(a, b, c) are converted into the color component of white (W) as described above, the image processing circuit 70 outputs, as the pixel signal IW, a signal corresponding to the gradation value "127". The signal output circuit 8 provides pixel signals (for example, the pixel signals IR, IG, IB, and IW) provided by the image processing circuit 70 to the pixel Pix through the signal line 4.

Figure 6:
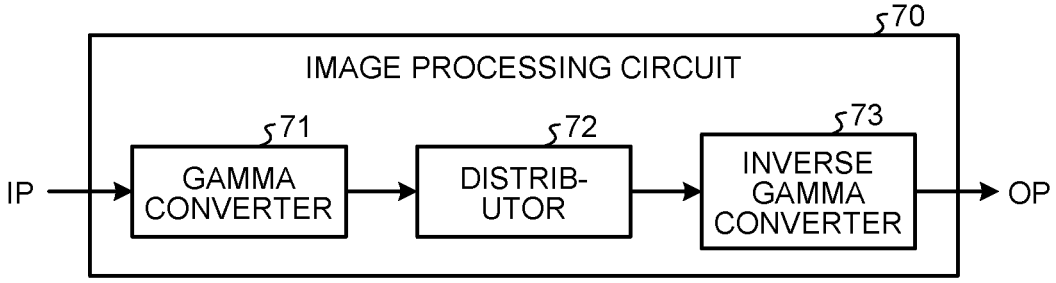
FIG. 6 is a block diagram illustrating an exemplary functional configuration of the image processing circuit.

FIG. 6 is a block diagram illustrating an exemplary functional configuration of the image processing circuit 70. The image processing circuit 70 functions as, for example, a gamma converter (gamma conversion circuit) 71, a distributor (distribution circuit) 72, and an inverse gamma converter (inverse gamma conversion circuit) 73.

Based on a pre-registered gamma value for the display part 7, the gamma converter 71 performs gamma correction on color components expressed in RGB gradation values represented by a plurality of pieces of pixel data included in the frame image data IP. The gamma value is, for example, a value in a range of 1 to 2.2, but not limited thereto and may be an arbitrary value that is appropriate as the gamma value. The above-described (R, G, B)=(a, b, c) are gradation values after the gamma correction by the gamma converter 71.

The distributor 72 performs the above-described conversion processing and distributes part of (R, G, B)=(a, b, c) (for example, (R, G, B)=(127, 127, 127) described above) from (R, G, B)=(a, b, c). Thus, the conversion processing to be performed by the image processing circuit 70 in the above description is performed by the distributor 72.

Based on the reciprocal of the above-described gamma value, the inverse gamma converter 73 performs inverse gamma correction on the color component derived from part of (R, G, B)=(a, b, c) by the conversion processing by the distributor 72 and the color components of R, G, B excluding the part from (R, G, B)=(a, b, c). For example, the "signal corresponding to (a−127)", the "signal corresponding to (b−127)", the "signal corresponding to (c−127)", and the "signal corresponding to (R, G, B)=(127, 127, 127)" described above are signals on which the inverse gamma correction is reflected.

The above description is based on (R, G, B)=(a, b, c) for one pixel Pix, but in reality, the same processing is individually performed for the pixel signals provided to each pixel Pix. Specifically, the gamma processing, the conversion processing, and the inverse gamma conversion processing are individually performed for each of a plurality of pieces of pixel data included in the frame image data IP, whereby the pixel signals for each pixel Pix are generated from the frame image data IP.

The lighting period LF is a period provided after the writing period WF of each subframe period. The lighting period LF is a period in which the light source 11 is turned on. When light is emitted from the light source 11, the display part 7 is illuminated with light incident from one side surface thereof in the Y direction. Each pixel Pix transmits or scatters the light incident from one side surface in the Y direction. The scattering degree depends on the state of the liquid crystal 3, which is controlled in accordance with pixel signals, in other words, voltage generated between each pixel Pix and the corresponding common electrode 6 in accordance with pixel signals provided in the writing period WF. The light source 11 is off in the writing period WF and the blanking period BF.

The color of light emitted to a pixel Pix in the lighting period LF of the first subframe period SF1, the color of light emitted to the pixel Pix in the lighting period LF of the second subframe period SF2, and the color of light emitted to the pixel Pix in the lighting period LF of the third subframe period SF3 are different from one another. In the lighting period LF of the first subframe period SF1, the first light source 11R is turned on to emit red (R) light LR to the pixel Pix. In the lighting period LF of the second subframe period SF2, the second light source 11G is turned on to emit green (G) light LG to the pixel Pix. In the lighting period LF of the third subframe period SF3, the third light source 11B is turned on to emit blue (B) light LB to the pixel Pix.

In examples illustrated in FIGS. 4, 7, and 9, the color of light emitted to the pixel Pix in the lighting period LF of the fourth subframe period SF4 includes one or more of the colors of light emitted in the subframe periods other than the fourth subframe period SF4. In the example illustrated in FIG. 4, the first light source 11R, the second light source 11G, and the second light source 11G are on in the lighting period LF of the fourth subframe period SF4. Thus, in the example illustrated in FIG. 4, the color of light emitted to the pixel Pix in the lighting period LF of the fourth subframe period SF4 is visually recognized as white (W) light by a user by additive color mixture.

The blanking period BF occurs between the lighting period LF included in the earlier subframe period among two subframe periods that are continuous in time, and the writing period WF included in the later subframe period. The blanking period BF is a period in which the voltage of the pixels Pix is reset. Specifically, in the blanking period BF, the scanning circuit 9 provides the potential that functions as the drive signal to all of the scanning lines 5. At a timing at which the drive signal is provided, all of the signal lines 4 are coupled to a reset potential line (not illustrated). The pixel electrodes 2 assume a potential equal to that provided to the reset potential line. The potential of the reset potential line is equal to the potential of each common electrode 6 after the blanking period BF.

In the embodiment, inversion drive is performed in the blanking period BF. The inversion drive means potential control of the common electrodes 6 in which the common electrodes 6 and the potential thereof are periodically switched. In the embodiment, the potential of the common electrodes Vodd and the potential of the common electrodes Veven are switched at each blanking period BF.

In the examples illustrated in FIGS. 4, 7, and 9, the potential of the common electrodes 6 takes one value from among a first potential V1 and a second potential V2. The examples illustrated in FIGS. 4, 7, and 9 describe a potential shift graph W1 and a potential shift graph W2. The potential shift graph W1 indicates that the potential becomes the first potential V1 in the writing period WF and the lighting period LF of each of the first subframe period SF1 and the third subframe period SF3, and the potential becomes the second potential V2 in the writing period WF and the lighting period LF of each of the second subframe period SF2 and the fourth subframe period SF4. The potential shift graph W2 indicates that the potential becomes the second potential V2 in the writing period WF and the lighting period LF of each of the first subframe period SF1 and the third subframe period SF3 and the potential becomes the first potential V1 in the writing period WF and the lighting period LF of each of the second subframe period SF2 and the fourth subframe period SF4. One of each common electrode Vodd and each common electrode Veven is controlled to become a potential corresponding to the potential shift graph W1. The other of each common electrode Vodd and each common electrode Veven is controlled to become a potential corresponding to the potential shift graph W2.

Although cases of a row inversion drive method that is performed on a subframe period basis is exemplarily illustrated in FIGS. 4, 7, and 9, the inversion drive method is not limited thereto. For example, when a configuration in which a thin-film common electrode 6 is shared by all pixels Pix is employed, the potential of the common electrode 6 may be periodically switched in a cycle of one or more frame periods F or in a cycle of one or more subframe periods. Alternatively, the pixels Pix may be coupled to different common electrodes 6 on a column basis in place of a row basis or may be coupled to different common electrodes 6 on a pixel Pix basis. In these cases, the inversion drive is performed in a cycle of one or more frame periods F or in a cycle of one or more subframe periods so that adjacent common electrodes 6 have different potentials.

The first potential V1 is, for example, 25 volt (V). The second potential V2 is, for example, 0 V. The first potential V1 and the second potential V2 only need to be different from each other and are not limited to those potentials exemplarily illustrated.

Potential provided to the pixel electrode 2 by pixel signals (for example, the pixel signals IR, IG, IB, and IW) provided for the pixel Pix in the writing period WF corresponds to the potential of the common electrode 6 after switching in the previous blanking period BF. For example, when a pixel signal that generates voltage of 11 V is provided for the pixel Pix and the potential of the common electrode 6 is the first potential V1, the potential of V1+11 V is provided by the pixel signal. In this case, when the potential of the common electrode 6 is the second potential V2, the potential of V2+11 V is provided by the pixel signal.

The color component distributed from (R, G, B)=(a, b, c) by the conversion processing by the distributor 72 depends on tendency of the color generated based on the frame image data IP.

For example, when the proportion of pixel data that satisfies a predetermined condition in the frame image data IP is larger than the proportion of pixel data that does not satisfy the predetermined condition, the color component of white (W) is distributed from (R, G, B)=(a, b, c) by the conversion processing as described above. The pixel data that satisfies the predetermined condition is pixel data from which (R, G, B)=($\alpha$, $\alpha$, $\alpha$) convertible into white (W) can be extracted and with which "a−$\alpha$", "b−$\alpha$", "c−$\alpha$", and "$\alpha$" can be set to be "equal to or smaller than half of the highest gradation value" in the relation between (R, G, B)=(a, b, c) and (R, G, B)=($\alpha$, $\alpha$, $\alpha$). The value $\alpha$ corresponds to half of "the highest value among "a", "b", and "c"".

When the proportion of pixel data that does not satisfy the above-described predetermined condition but indicates an RGB gradation value including a color component convertible into one particular color among complementary colors of R, G, and B in the frame image data IP is larger than the proportion of the other pixel data, the color component of the one particular color is distributed from (R, G, B)=(a, b, c) by the conversion processing as described above.

The complementary colors of R, G, and B are cyan (C), magenta (M), and yellow (Y). When the color component of yellow (Y) is distributed from (R, G, B)=(a, b, c), (R, G, B)=(a, b, c) indicates RGB gradation values from which (R, G, B)=($\beta$, $\beta$, 0) can be extracted, and the proportion of pixel data with which "a=β", "b−β", "c", and "β" can be set to be "equal to or smaller than half of the highest gradation value", is larger than the proportion of pixel data with which such a setting is impossible. The value p corresponds to half of "the highest value among a, b, and c". When the color component of magenta (M) is distributed from (R, G, B)=(a, b, c), (R, G, B)=(a, b, c) indicates RGB gradation values including color components such as (R, G, B)=(γ, 0, γ), and the proportion of pixel data with which "a−γ", "b", "c−γ", and "γ" can be set to be "equal to or smaller than half of the highest gradation value", is larger than the proportion of pixel data with which such a setting is impossible. The value γ corresponds to half of "the highest value among a, b, and c". When the color component of cyan (C) is distributed from (R, G, B)=(a, b, c), (R, G, B)=(a, b, c) indicates RGB gradation values including color components such as (R, G, B)=(0, ω, ω), and the proportion of pixel data with which "a", "b−ω", "c−ω", and co can be set to be "equal to or smaller than half of the highest gradation value", is larger than the proportion of pixel data with which such a setting is impossible. The co corresponds to half of "the highest value among a, b, and c".

Figure 8:
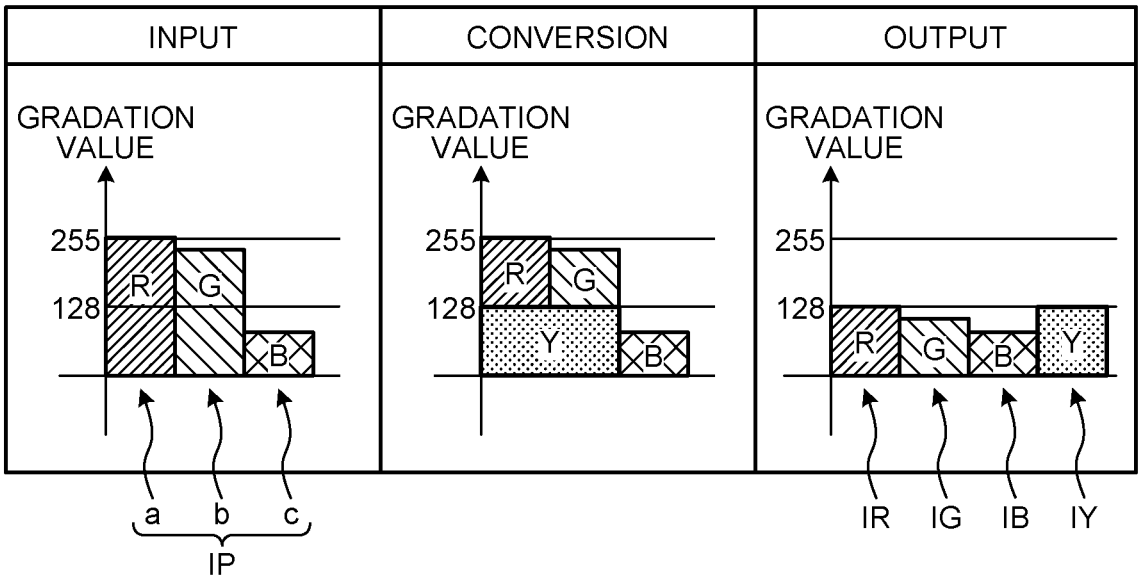
FIG. 8 is a diagram illustrating an exemplary relation between the pixel data included in the frame image data input to the image processing circuit and the pixel signals output from the image processing circuit.

The following describes, with reference to FIGS. 7 and 8, a case in which the color component of yellow (Y) is distributed from (R, G, B)=(a, b, c) as an exemplary case in which one particular color among the complementary colors of R, G, and B is distributed from (R, G, B)=(a, b, c) by the conversion processing.

FIG. 7 is a time chart illustrating the details of exemplary control using the FSC scheme when a pixel signal IY is provided to the pixel Pix in the writing period WF of the fourth subframe period SF4. The time chart illustrated in FIG. 7 is the same as the time chart illustrated in FIG. 4 except that the pixel signal IY is provided to the pixel Pix in the writing period WF of the fourth subframe period SF4 and the first light source 11R and the second light source 11G are turned on but the third light source 11B is not turned on in the lighting period LF of the fourth subframe period SF4.

The pixel signal IY illustrated in FIG. 7 is a signal corresponding to a color that can be generated by a combination of "a" and "b" among (R, G, B)=(a, b, c).

FIG. 8 is a diagram illustrating an exemplary relation between the pixel data included in the frame image data IP input to the image processing circuit 70 and the pixel signals IR, IG, IB, and IY output from the image processing circuit 70. The "input" column illustrated in FIG. 8 is the same as the "input" column illustrated in FIG. 5 except that "c" among (R, G, B)=(a, b, c) is smaller than 128.

In the example illustrated in FIG. 8, the distributor 72 performs conversion processing that derives yellow (Y) from (R, G, B)=(a, b, c). The "conversion" column in FIG. 8 illustrates that (R, G, B)=(127, 127, 0) among (R, G, B)=(a, b, c) become yellow (Y) by the conversion processing.

The distributor 72 outputs, as the pixel signals IR, IG, and IB to the signal output circuit 8, signals corresponding to gradation values obtained by subtracting R, G, and B values included in a color component obtained as yellow (Y) by the conversion from (R, G, B)=(a, b, c). In a specific example, when (R, G, B)=(127, 127, 0) among (R, G, B)=(a, b, c) are converted into the color component of yellow (Y) as described above, the distributor 72 outputs, as the pixel signal IR, a signal corresponding to (a−127) in (R, G, B)=((a−127), 0, 0). In this case, the distributor 72 outputs, as the pixel signal IG, a signal corresponding to (b−127) in (R, G, B)=(0, (b−127), 0). In addition, in this case, the distributor 72 outputs, as the pixel signal IB, a signal corresponding to "c" in (R, G, B)=(0, 0, c).

The distributor 72 also outputs, as the pixel signal IY to the signal output circuit 8, a signal corresponding to any non-zero gradation value among R, G, and B gradation values included in the color component obtained as yellow (Y) by the conversion among (R, G, B)=(a, b, c). In a specific example, when signals corresponding to (R, G, B)=(127, 127, 0) among (R, G, B)=(a, b, c) are converted into the color component of yellow (Y) as described above, the distributor 72 handles, as the pixel signal IY, a signal corresponding to the gradation value "127". The image processing circuit 70 outputs the pixel signals IR, IG, IB, and IY generated in this manner to the signal output circuit 8. The signal output circuit 8 provides, to the pixel Pix through the signal line 4, the pixel signals IR, IG, IB, and IY provided by the image processing circuit 70.

In the lighting period LF of the fourth subframe period SF4, the pixel Pix is irradiated with light in colors corresponding to the color components of pixel signals provided in the writing period WF of the fourth subframe period SF4. For example, when the pixel signal IY is provided in the writing period WF of the fourth subframe period SF4 as illustrated in FIG. 7, the first light source 11R and the second light source 11G are turned on but the third light source 11B is not turned on. The example illustrated in FIGS. 7 and 8 is the same as the example illustrated in FIGS. 4 and 5 except for any point described otherwise above.

In the example described above with reference to FIGS. 7 and 8, the color distributed to the fourth subframe period SF4 by the conversion processing is yellow (Y), and the same idea of distribution also applies to a case of another complementary color (magenta (M) or cyan (C)) except that a color component included in the complementary color is different from yellow (Y).

When the proportion of pixel data indicating such RGB gradation values that the gradation value of one color among R, G, and B is more than twice the gradation values of the other two colors in the frame image data IP is larger than the proportion of the other pixel data, the color component of the one color is distributed from (R, G, B)=(a, b, c) by the conversion processing as described above.

Figure 10:
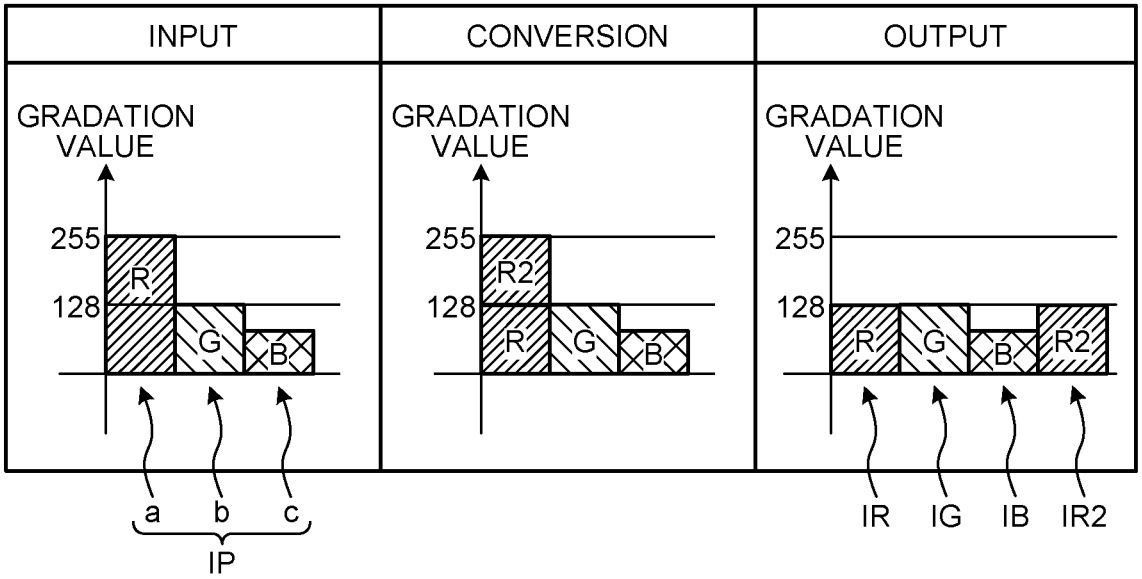
FIG. 10 is a diagram illustrating an exemplary relation between the pixel data included in the frame image data input to the image processing circuit and the pixel signals output from the image processing circuit.

The following describes, with reference to FIGS. 9 and 10, a case in which the color component of red (R) is distributed from (R, G, B)=(a, b, c) as an exemplary case in which one particular color among R, G, and B is distributed from (R, G, B)=(a, b, c) by the conversion processing.

FIG. 9 is a time chart illustrating the details of exemplary control using the FSC scheme when a pixel signal IR2 is provided to the pixel Pix in the writing period WF of the fourth subframe period SF4. The time chart illustrated in FIG. 9 is the same as the time chart illustrated in FIG. 4 except that the pixel signal IR2 is provided to the pixel Pix in the writing period WF of the fourth subframe period SF4 and the first light source 11R is turned on in the lighting period LF of the fourth subframe period SF4 but the second light source 11G and the third light source 11B are not turned on.

The pixel signal IR2 illustrated in FIG. 9 is a signal corresponding to a color that can be generated by "a" among (R, G, B)=(a, b, c).

FIG. 10 is a diagram illustrating an exemplary relation between the pixel data included in the frame image data IP input to the image processing circuit 70 and the pixel signals IR, IG, IB, and IR2 output from the image processing circuit 70. The "input" column illustrated in FIG. 10 is the same as the "input" column illustrated in FIG. 5 except that "b" and "c" among (R, G, B)=(a, b, c) are smaller than 128.

In the example illustrated in FIG. 10, the distributor 72 performs conversion processing that divides the color component (a) of red (R) among (R, G, B)=(a, b, c) into two. The "conversion" column in FIG. 8 indicates that the color component (a) of red (R) among (R, G, B)=(a, b, c) is divided into "R" and "R2".

The distributor 72 handles, as the pixel signal IR, a signal corresponding to a component obtained by subtracting a component corresponding to "R2" from the color component (a) of red (R). The distributor 72 handles, as the pixel signal IG, a signal corresponding to "b" in (R, G, B)=(a, b, c). The distributor 72 handles, as the pixel signal IB, a signal corresponding to "c" in (R, G, B)=(a, b, c). The distributor 72 handles, as the pixel signal IR2, the signal corresponding to the component corresponding to "R2". The image processing circuit 70 outputs the pixel signals IR, IG, IB, and IR2 generated in this manner to the signal output circuit 8. The signal output circuit 8 provides, to the pixel Pix through the signal line 4, the pixel signals IR, IG, IB, and IR2 provided by the image processing circuit 70.

In the lighting period LF of the fourth subframe period SF4, the pixel Pix is irradiated with light in colors corresponding to the color components of pixel signals provided in the writing period WF of the fourth subframe period SF4. For example, when the pixel signal IR2 is provided in the writing period WF of the fourth subframe period SF4 as illustrated in FIG. 7, the first light source 11R is turned on but the second light source 11G and the third light source 11B are not turned on. The example illustrated in FIGS. 9 and 10 is the same as the example illustrated in FIGS. 4 and 5 except for any point described otherwise above.

In the example described above with reference to FIGS. 9 and 10, the color distributed to the fourth subframe period SF4 by the conversion processing is red (R), and the same idea of distribution also applies to another primary color (green (G) or blue (B)) except for the color difference.

According to the embodiment described above with reference to FIGS. 1 to 10, the voltage at each pixel Pix, in other words, the potential difference between the corresponding pixel electrode 2 and the corresponding common electrode 6 is more likely to be reduced. The following describes a reference example that is different from the embodiment with reference to FIGS. 11 and 12.

Figure 11:
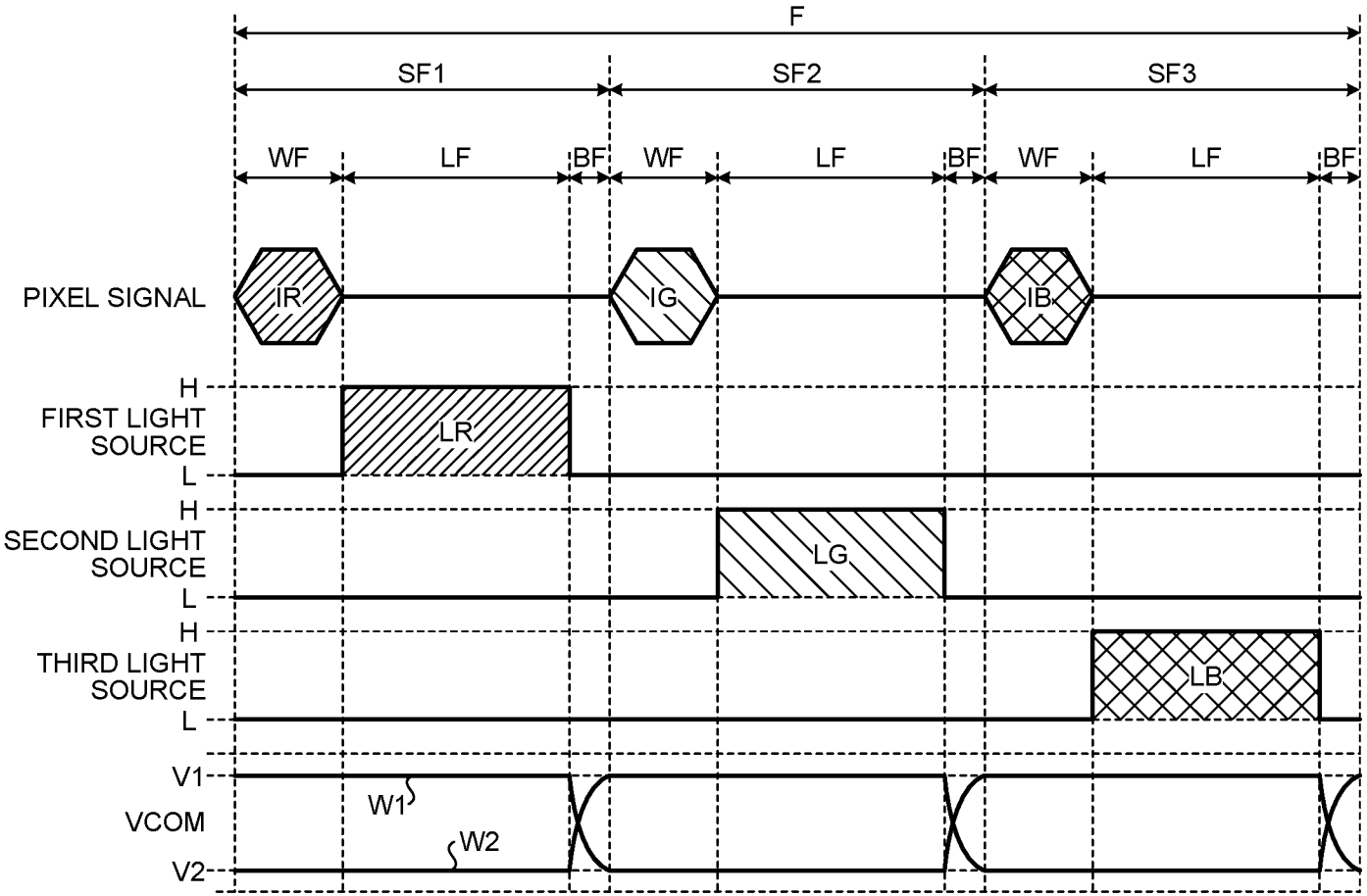
FIG. 11 is a time chart illustrating the details of exemplary control using the FSC scheme according to a reference example.

FIG. 11 is a time chart illustrating the details of exemplary control using the FSC scheme according to the reference example. The time chart illustrated in FIG. 11 is the same as the time chart described above with reference to FIG. 4 except that no fourth subframe period SF4 is provided.

Figure 12:
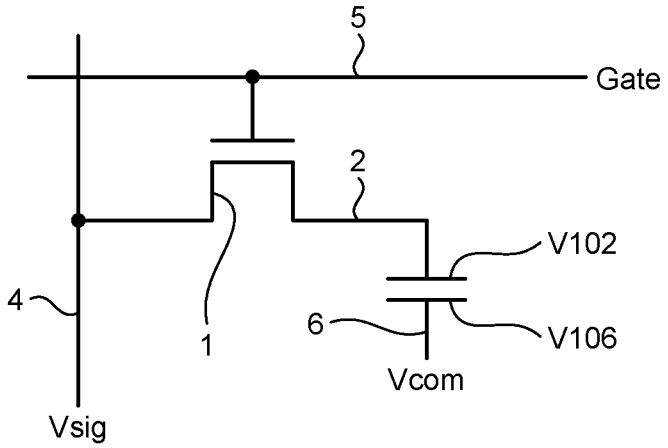
FIG. 12 is a circuit diagram for description of a potential difference that occurs at a pixel in the reference example.

FIG. 12 is a circuit diagram for description of a potential difference that occurs at a pixel according to the reference example. As illustrated in FIG. 12, in a configuration according to the reference example in which a pixel signal Vsig is provided from the signal line 4 to the pixel electrode 2 through the switching element 1 and a common potential Vcom is provided to the common electrode 6, the voltage of the pixel corresponds to the potential difference between a potential V102 on the pixel electrode 2 side and a potential V106 on the common electrode 6 side. The potential V102 corresponds to the pixel signal Vsig provided from the signal line 4 to the pixel electrode 2 through the switching element 1. The potential V106 corresponds to the common potential Vcom.

According to the same idea as that described above for the writing period WF, a drive signal Gate is provided to the scanning line 5 in a period in which the pixel signal Vsig is provided from the signal line 4 to the pixel electrode 2 through the switching element 1 in the reference example. The voltage of the drive signal Gate is, for example, 41 V. The potential of the scanning line 5 is, for example, −8 V in a period during which the drive signal Gate is not provided.

Figure 13:
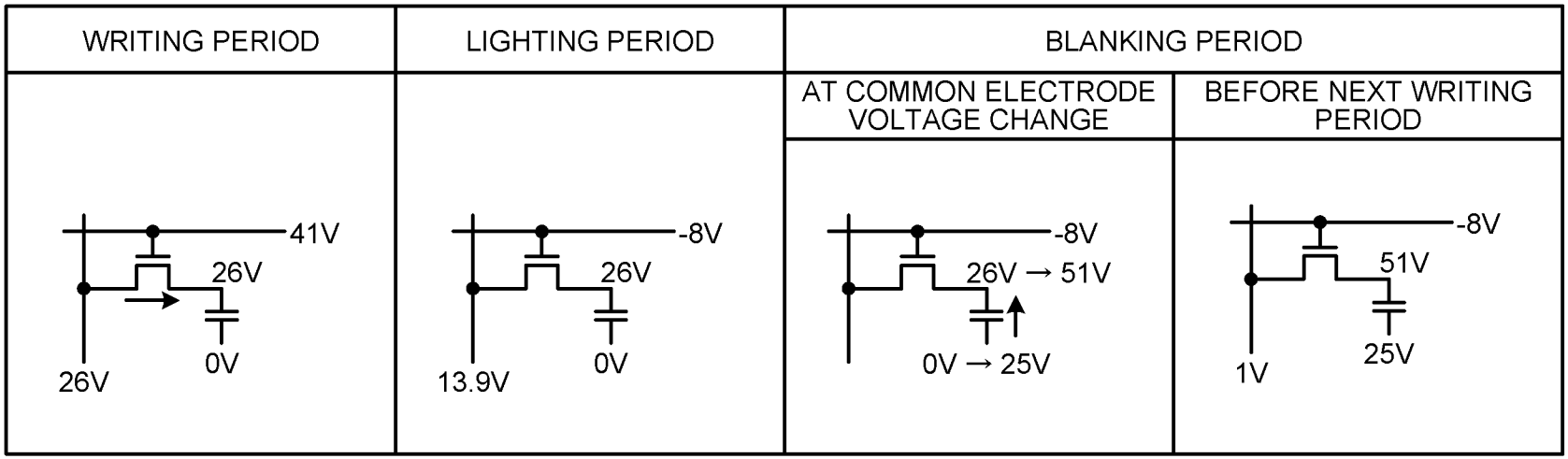
FIG. 13 is a diagram illustrating exemplary potential change that occurs at a pixel in the reference example.

FIG. 13 is a diagram illustrating exemplary potential change that occurs at the pixel according to the reference example. When the same inversion drive as described above in the embodiment is applied to the reference example, the potential V106 is the first potential V1 (for example, 25 V) or the second potential V2 (for example, 0 V) and is switched between the first potential V1 and the second potential V2 periodically. The potential of the circuit board 102 is controlled in accordance with the potential V106, which is periodically switched between the first potential V1 and the second potential V2 in this manner, so that scattering of light corresponding to a gradation value occurs at the pixel. For example, consider a case in which the voltage of 26 V needs to be applied to the pixel so that scattering of light corresponding to the highest gradation value occurs at the pixel, and the potential V106 is changed from the second potential (for example, 0 V) to the first potential V1 (for example, 25 V) as illustrated in "at common electrode voltage change" of "blanking period" in FIG. 13. In this case, the potential V102 is changed from 26 V in "lighting period" to 51 V. The potential of the scanning line 5 in this case is, for example, −8 V, and therefore, voltage applied between the source (or drain) and gate of the switching element 1 coupled to the pixel electrode 2 is 59 V in the reference example. It has been empirically known that, when such a high voltage is continuously applied to the pixel, the lifetime of the pixel is significantly shortened as compared to a case in which the high voltage is not provided.

However, in the embodiment, when gradation values indicated by a plurality of pieces of pixel data included in the frame image data IP include a gradation value exceeding the middle value thereof, the gradation value is divided so as to be equal to or smaller than the middle value by the above-described conversion processing and is allocated to the fourth subframe period SF4. Specifically, in the embodiment, the number of pixels Pix provided with voltage corresponding to gradation values equal to or smaller than the middle value can be increased as compared to that in the reference example. Thus, according to the embodiment, it is possible to provide a display device having a longer lifetime. Moreover, since the number of pixels Pix provided with voltage corresponding to gradation values equal to or smaller than the middle value can be further increased, it is possible to relax requirements for voltage resistance performance (maximum rating) of the switching element 1 provided for each pixel Pix. Specifically, since extremely high voltage "at common electrode voltage change", such as 51 V exemplarily described above is unlikely to occur in the embodiment, it is not necessary to meet excessive requirements for voltage resistance performance. Thus, it is possible to employ the switching element 1 having a gate-source (drain) breakdown voltage that is lower than voltage (for example, 59 V at maximum) corresponding to the maximum gradation value of the pixel Pix.

As described above, according to the present disclosure, the display device 100 includes the first substrate 30, the second substrate 20 facing the first substrate 30, the liquid crystal 3 sandwiched between the first substrate 30 and the second substrate 20, the pixel electrodes 2 provided to the first substrate 30 or the second substrate 20 and disposed individually at the plurality of pixels Pix, the common electrode 6 provided to the first substrate 30 or the second substrate 20 and shared by two or more pixels Pix, the light source 11 configured to emit light to the pixels Pix, and an image processor (image processing circuit 70) configured to generate a signal to be provided to each pixel based on an input image signal (frame image data IP). The light source 11 includes the first light source 11R configured to emit light in a first color, the second light source 11G configured to emit light in a second color, and the third light source 11B configured to emit light in a third color. The frame period F in which an image is displayed by the pixels Pix includes the first subframe period SF1 including a period in which the first light source 11R is on, the second subframe period SF2 including a period in which the second light source 11G is on, the third subframe period SF3 including a period in which the third light source 11B is on, and the fourth subframe period SF4 including a period in which one or more of the first light source 11R, the second light source 11G, and the third light source 11B are on. The image processor divides a gradation value indicated by the input image signal (frame image data IP) into two gradation values smaller than the gradation value indicated by the input image signal, allocates one of the two gradation values to the fourth subframe period SF4, and allocates the other gradation value to the first subframe period SF1, the second subframe period SF2, or the third subframe period SF3.

According to the present disclosure, the gradation value indicated by the input image signal (frame image data IP) is distributed to the fourth subframe period SF4 and another subframe period. Thus, it is possible to lower the voltage of a pixel Pix provided with a signal corresponding to the gradation value as compared to a case in which the gradation value is allocated to one subframe period. Therefore, it is possible to restrain lifetime shortening of the pixel Pix that would be caused by high voltage. In this manner, according to the present disclosure, the display device 100 is likely to have a longer lifetime.

The image processor (image processing circuit 70) divides the gradation value indicated by the input image signal (frame image data IP) into two gradation values equal to or smaller than half of the gradation value, allocates one of the two gradation values to the fourth subframe period SF4, and allocates the other gradation value to the first subframe period SF1, the second subframe period SF2, or the third subframe period SF3. Thus, it is possible to more reliably lower the voltage of the pixel Pix provided with the signal corresponding to the gradation value as compared to a case in which the gradation value is allocated to one subframe period.

The first subframe period SF1, the second subframe period SF2, the third subframe period SF3, and the fourth subframe period SF4 each include a writing period WF in which a pixel signal corresponding to the potential difference between the common electrode 6 and the pixel electrode 2 is supplied to the pixel electrode 2 through the signal line 4 coupled to the pixel electrode 2, a lighting period LF in which one or more of the first light source 11R, the second light source 11G, and the third light source 11B are turned on after the writing period WF, and a voltage change period (blanking period BF) in which the voltage of the common electrode 6 is changed. The potential of the pixel electrode 2 facing the common electrode 6 having a relatively high potential (first potential V1) after the voltage change period is likely to be higher than the potential of the pixel electrode 2 facing the common electrode 6 having a relatively low potential (second potential V2) after the voltage change period. However, in the present disclosure, since the gradation value indicated by the input image signal (frame image data IP) is distributed to the fourth subframe period SF4 and another subframe period, it is possible to lower the voltage of a pixel Pix provided with a signal corresponding to the gradation value as compared to a case in which the gradation value is allocated to one subframe period. Thus, it is possible to restrain lifetime shortening of the pixel Pix that would be caused by high voltage even when voltage change of the common electrode 6 in the voltage change period is taken into account. In this manner, according to the present disclosure, the display device 100 is likely to have a longer lifetime.

The light source 11 is provided on a lateral side with respect to a direction in which the first substrate 30 faces the second substrate 20. Thus, it is possible to achieve a longer lifetime of what is called a side-lighting display device.

The first color is red (R), the second color is green (G), and the third color is blue (B). Thus, it is possible to achieve a longer lifetime of a display device in which the light source 11 configured to emit what is called RGB light is employed.

The first light source 11R, the second light source 11G, and the third light source 11B are turned on in the fourth subframe period SF4, whereby white (W) is allocated to the fourth subframe period SF4. Specifically, since all RGB gradation values are allocated to the fourth subframe period SF4, it is possible to increase the probability that gradation values allocated to a pixel Pix in the first subframe period SF1, the second subframe period SF2, and the third subframe period SF3 are distributed to the fourth subframe period SF4, as well as increase the degree of the distribution.

The liquid crystal 3 is a polymer-dispersed liquid crystal. Thus, it is possible to achieve a longer lifetime of a display device of the FSC scheme using a polymer-dispersed liquid crystal.

In the above-described embodiment, an example such as a "case in which the proportion of pixel data that satisfies a predetermined condition is larger than the proportion of pixel data that does not satisfy the predetermined condition" is described. In such an example, the color indicated by a pixel signal allocated to the fourth subframe period SF4 and the color of light allocated to the fourth subframe period SF4 are determined based on the proportion of pixel data included in the frame image data IP, but the method of determining the color indicated by the pixel signal allocated to the fourth subframe period SF4 and the color of light allocated to the fourth subframe period SF4 is not limited thereto. For example, the color indicated by the pixel signal allocated to the fourth subframe period SF4 and the color of light allocated to the fourth subframe period SF4 may be a color to which the highest gradation value is allocated among red (R), green (G), blue (B), cyan (C), magenta (M), and yellow (Y) that are reproduced based on pixel data included in the frame image data IP. When the complementary color such as cyan (C), magenta (M), or yellow (Y) has the highest gradation value, the following conditions are satisfied: (1) among gradation values indicated by the pixel data, the gradation values of two primary colors (for example, red (R) and green (G)) that reproduce the complementary color are the same; and (2) the frame image data IP is received, which includes pixel data indicating that the gradation values of the two primary colors are highest and the other pixel data indicating gradation values equal to or smaller than the highest gradation values. When the color indicated by a pixel signal allocated to the fourth subframe period SF4 and the color of light allocated to the fourth subframe period SF4 are determined in this manner, it is possible to more reliably restrain increase in the potential of a pixel Pix that would be caused by a highest gradation value in accordance with an input data that has the highest gradation value and thus is likely to increase the voltage of the pixel Pix.

The specific circuit and substrate disposition described above with reference to FIG. 3 is merely an example and the present disclosure is not limited thereto. Any configuration including components functionally corresponding to those in FIG. 1 may be employed as a configuration of the present disclosure in place of the configuration illustrated in FIG. 3.

In the above-described embodiment, two gradation values determined to be equal to or smaller than half of a gradation value indicated by pixel data included in the frame image data IP are allocated to the fourth subframe period SF4 and one of the first subframe period SF1, the second subframe period SF2, and the third subframe period SF3. However, it is not essential that the two gradation values are equal to or smaller than half of the gradation value indicated by pixel data included in the frame image data IP, and one of the two gradation values may exceed half of the gradation value indicated by pixel data included in the frame image data IP. When part of the gradation value indicated by pixel data included in the frame image data IP including the two gradation values is distributed to the fourth subframe period SF4, the voltage of the pixel can be lowered as compared to a case in which the gradation value indicated by pixel data included in the frame image data IP including the two gradation values is allocated to one subframe period.

It should be understood that, among other effects achieved by aspects described in the embodiment, those clear from the present specification description or those that could be thought of by the skilled person in the art as appropriate are achieved by the present disclosure.

What is claimed is:

1. A display device comprising:

a first substrate;

a second substrate facing the first substrate;

a liquid crystal sandwiched between the first substrate and the second substrate;

pixel electrodes provided to the first substrate or the second substrate and disposed individually at a plurality of pixels;

a common electrode provided to the first substrate or the second substrate and shared by two or more pixels of the pixels;

a light source configured to emit light to the pixels; and an image processor configured to generate a signal to be provided to each pixel based on an input image signal, wherein the light source includes a first light source configured to emit light in a first color, a second light source configured to emit light in a second color, and a third light source configured to emit light in a third color, wherein a frame period in which an image is displayed by the pixels includes a first subframe period including a period in which the first light source is on, a second subframe period including a period in which the second light source is on, a third subframe period including a period in which the third light source is on, and a fourth subframe period including a period in which one or more of the first light source, the second light source, and the third light source are on, and wherein the image processor configured to divide a gradation value indicated by the image signal into two gradation values smaller than the gradation value indicated by the image signal, allocate one of the two gradation values to the fourth subframe period, and allocate the other gradation value to the first subframe period, the second subframe period, or the third subframe period.

2. The display device according to claim 1, wherein the image processor configured to divide the gradation value indicated by the image signal into two gradation values equal to or smaller than half of the gradation value, allocate one of the two gradation values to the fourth subframe period, and allocate the other gradation value to the first subframe period, the second subframe period, or the third subframe period.

3. The display device according to claim 2, wherein each of the first subframe period, the second subframe period, the third subframe period, and the fourth subframe period includes a writing period in which pixel signals corresponding to potential differences between the common electrode and the pixel electrodes are supplied to the respective pixel electrodes through signal lines coupled to the pixel electrodes, a lighting period in which one or more of the first light source, the second light source, and the third light source are turned on after the writing period, and a voltage change period in which voltage of the common electrode is changed.

4. The display device according to claim 1, wherein the light source is provided on a lateral side with respect to a direction in which the first substrate faces the second substrate.

5. The display device according to claim 1, wherein the first color is red, the second color is green, and the third color is blue.

6. The display device according to claim 1, wherein the first light source, the second light source, and the third light source are turned on in the fourth subframe period.

7. The display device according to claim 3, wherein light that is emitted in the fourth subframe period is light in a color having the highest gradation value indicated by the image signal, among the first color, the second color, the third color, a complementary color of the first color, a complementary color of the second color, and a complementary color of the third color.

8. The display device according to claim 1, wherein the liquid crystal is a polymer-dispersed liquid crystal.

* * * * *